US005275077A

United States Patent [19]

Kobayashi

[11] Patent Number: 5,275,077

[45] Date of Patent: Jan. 4, 1994

[54] METHOD OF FORMING PERFORATED CUT LINE BY CUTTING PLOTTER

[75] Inventor: Hisayuki Kobayashi, Nagano, Japan

[73] Assignee: Mimaki Engineering Co., Ltd., Nagano, Japan

[21] Appl. No.: 662,471

[22] Filed: Feb. 27, 1991

[51] Int. Cl.[5] ..... B26D 3/08; B26F 1/02

[52] U.S. Cl. ..... 83/880; 83/30; 83/427; 83/428; 83/575

[58] Field of Search ..... 83/879, 890, 881, 13, 83/56, 617, 647, 660, 30, 575, 577, 427, 428

[56] References Cited

U.S. PATENT DOCUMENTS

| | | | |
|---|---|---|---|
| 3,973,453 | 8/1976 | Tameo | 83/660 X |
| 4,467,525 | 8/1984 | Logan et al. | 83/879 X |
| 4,524,894 | 6/1985 | Leblond | 83/879 |
| 4,732,069 | 3/1988 | Wood et al. | 83/879 X |
| 4,920,495 | 4/1990 | Pilkington | 83/880 X |
| 5,136,910 | 8/1992 | Kuhn et al. | 83/881 X |

*Primary Examiner*—Frank T. Yost
*Assistant Examiner*—Kenneth E. Peterson
*Attorney, Agent, or Firm*—Price, Gess & Ubell

[57] ABSTRACT

A method of forming a perforated cut line using a cutting plotter capable of accurately and rapidly forming a sheet with a perforated cut line along a cut line which is predetermined on a sheet and along which the sheet is to be cut. A cutter pressure at which a cutter is pressed onto the sheet is repeatedly reduced for a micro period of time at predetermined time intervals to form the sheet with a perforated cut line consisting of perforations and unperforated parts defined between the perforations in an intermittent manner.

8 Claims, 3 Drawing Sheets

METHOD OF FORMING PERFORATED CUT LINE BY CUTTING PLOTTER

BACKGROUND OF THE INVENTION

1. Field of the Invention

This invention relates to a method of forming a perforated cut line by a cutting plotter, and more particularly to a method of forming a sheet with perforations along a cut line which is predetermined or defined on the sheet and along which the sheet is to be cut out, to thereby provide an article suitable for use as an apparel paper pattern, a bag or the like.

2. Description of Related Art

Conventionally, cutting plotters of the paper moving type (X-moving pen carriage type: vertical or horizontal type) and the flat-bed type (XY-moving pen carriage type: horizontal type) have been proposed, each of which includes a pen carriage arranged so as to be movable in X and Y directions relative to a sheet put on a recording surface and provided with a cutter. The so-constructed cutting plotters are each used in such a manner that the sheet is put on the recording surface and then the pen carriage is relatively moved above the sheet in the X and Y directions with respect to the sheet as desired while the cutter is contactedly pressed onto the sheet at a predetermined cutter pressure, so that the sheet is cut out into a desired configuration.

In the cutting plotter of the vertical type, the sheet is moved on the recording surface in the Y direction by means of a combination of a grit roller and a pinch roller arranged as a pair in the vertical direction while being interposed between both rollers, resulting in the pen carriage being relatively moved with respect to the sheet. Such construction of the paper moving type cutting plotter, when a part of the sheet is cut as a round piece out of the sheet, causes the cut part to be separated from the remaining part of the sheet interposedly held between the grit roller and the pinch roller, resulting in the transmission of drive force of the grit roller and/or pinch roller to the cut part failing. Unfortunately, this causes a jamming phenomenon so that the sheet being cut is complicatedly deformed and folded on the recording surface.

Such a jamming phenomenon is likewise encountered with the flat-bed type cutting plotter. More particularly, in the flat-bed type cutting plotter, the sheet is securely positioned on the recording surface by fixing the corners of the sheet to the recording surface by using a fixing means such as an adhesive tape or the like. Unfortunately, when a part of the sheet is cut as a round piece out of the sheet, this cutting method causes the cut part to be separated or released from the remaining part of the sheet held on the recording surface by the fixing means, so that the remaining part is moved in all directions because the cutter forcedly pushes it, also resulting in the jamming phenomenon occurring.

In view of the above disadvantage of the conventional paper moving type and flat-bed type cutting plotters, an improved cutting plotter is proposed which is constructed so as to intermittently provide the sheet with unperforated parts of a small length at predetermined intervals along a cut line which is described on the sheet and along which the sheet is to be subsequently cut out, to thereby form the sheet with perforations along the cut line of the sheet, resulting in a perforated cut line. The sheet is cut out into a desired shape such as a circular shape or the like depending upon the shape of the perforated cut line in a subsequent step. The cutting may be carried out manually.

The improved cutting plotter is divided into two types of plotters, a paper moving type and a flat-bed type. The paper moving type cutting plotter is constructed so that the driving force of a grit roller and/or a pinch roller for interposedly holding the remaining part of the sheet other than a part of the sheet to be subsequently cut out is positively continuously transmitted, during the perforation forming operation, to the part of the sheet to be subsequently cut out into a circular shape or the like. Also, the flat-bed type cutting plotter takes a measure of fixing the part of the sheet to be cut out into a circular shape or the like onto the recording surface through the remaining part of the sheet by means of an adhesive tape or the like during the perforation forming operation. After the sheet is formed with the perforated cut line as described above, the unperforated parts of the perforated cut line of the sheet may be manually laterally cut or broken to separate the cut part of the sheet from the remaining part of the sheet.

The formation of the perforations along the cut line predetermined or defined on the sheet by means of the formerly improved paper moving type or flat-bed type cutting plotter is carried out by stopping the movement of the cutter relative to the sheet along the cut line at predetermined time intervals while contactedly pressing the cutter onto the sheet, and by raising the cutter above the sheet during the stopping period. Then, the cutter is moved a micro distance along the cut line on the sheet relative to the sheet to form the sheet with an unperforated part along the cut line. Then, during the period of the next stopping, the cutter is lowered for the subsequent perforation motion. Such procedure is repeated to form the sheet with a number of perforations at predetermined intervals along the cut line, resulting in the perforated cut line being formed.

Unfortunately, the repeating of vertical movement of the cutter at the predetermined time intervals to form the perforations and unperforated parts along the cut line on the sheet requires much time, so that operating efficiency substantially deteriorates.

BRIEF SUMMARY OF THE INVENTION

The present invention has been made in view of the foregoing disadvantage of the prior art.

Accordingly, it is an object of the present invention to provide a method of forming a perforated cut line on a sheet using a cutting plotter which is capable of significantly improving operating efficiency.

It is another object of the present invention to provide a method of forming a perforated cut line on a sheet using a cutting plotter which is capable of accomplishing the formation of the perforated cut line in a short period of time.

It is a further object of the present invention to provide a method of forming a perforated cut line on a sheet using a cutting plotter which is capable of readily and accurately carrying out the formation of perforations.

It is still another object of the present invention to provide a method of forming a perforated cut line on a sheet using a cutting plotter which is capable of carrying out the formation of the perforated cut line with a simple structure.

In accordance with the present invention, a method of forming a perforated cut line is provided. The method is carried out by using a cutting plotter which is adapted to relatively move a pen carriage in X and Y directions with respect to a sheet while contactedly pressing a cutter supported on the pen carriage onto the sheet at a predetermined cutter pressure in a manner to be vertically movable with respect to the sheet. The method comprises the step of repeatedly reducing the cutter pressure for a micro period of time at predetermined time intervals to form the sheet with a perforated cut line comprising perforations and unperforated parts interposedly arranged between the perforations.

In the method of the present invention constructed as described above, the reduction of the cutter pressure in an intermittent manner causes a repulsion force of the sheet to raise the cutter by a micro distance, to thereby intermittently form the sheet with the unperforated parts, resulting in the perforated cut line.

In a preferred embodiment of the present invention, the reduction of the cutter pressure is carried out to such a degree that a groove of a given depth is formed on each of the unperforated parts. The unperforated parts thus formed with the grooves permit the cutting of the sheet along the perforated cut line to be more readily accomplished.

In a preferred embodiment of the present invention, the repeated reduction of the cutter pressure is carried out while the cutter is relatively and continuously moved in the X and Y directions with respect to the sheet. Such construction permits the forming of the perforated cut line to be rapidly accomplished.

Also, in a preferred embodiment of the present invention, the movement of the cutter relative to the sheet is stopped every time that the formation of one of the unperforated parts is started and terminated. This leads to the positive and accurate formation of the perforated cut line.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout, wherein.

DETAILED DESCRIPTION OF THE PREFERRED EMBODIMENT

Now, a method of forming a perforated cut line by a cutting plotter according to the present invention will be described hereinafter with reference to FIGS. 1 to 4.

First, a paper moving type cutting plotter, which is an example of a cutting plotter used for practicing a method of forming a perforated cut line according to the present invention, will be described with reference to FIG. 1.

Figure 1:
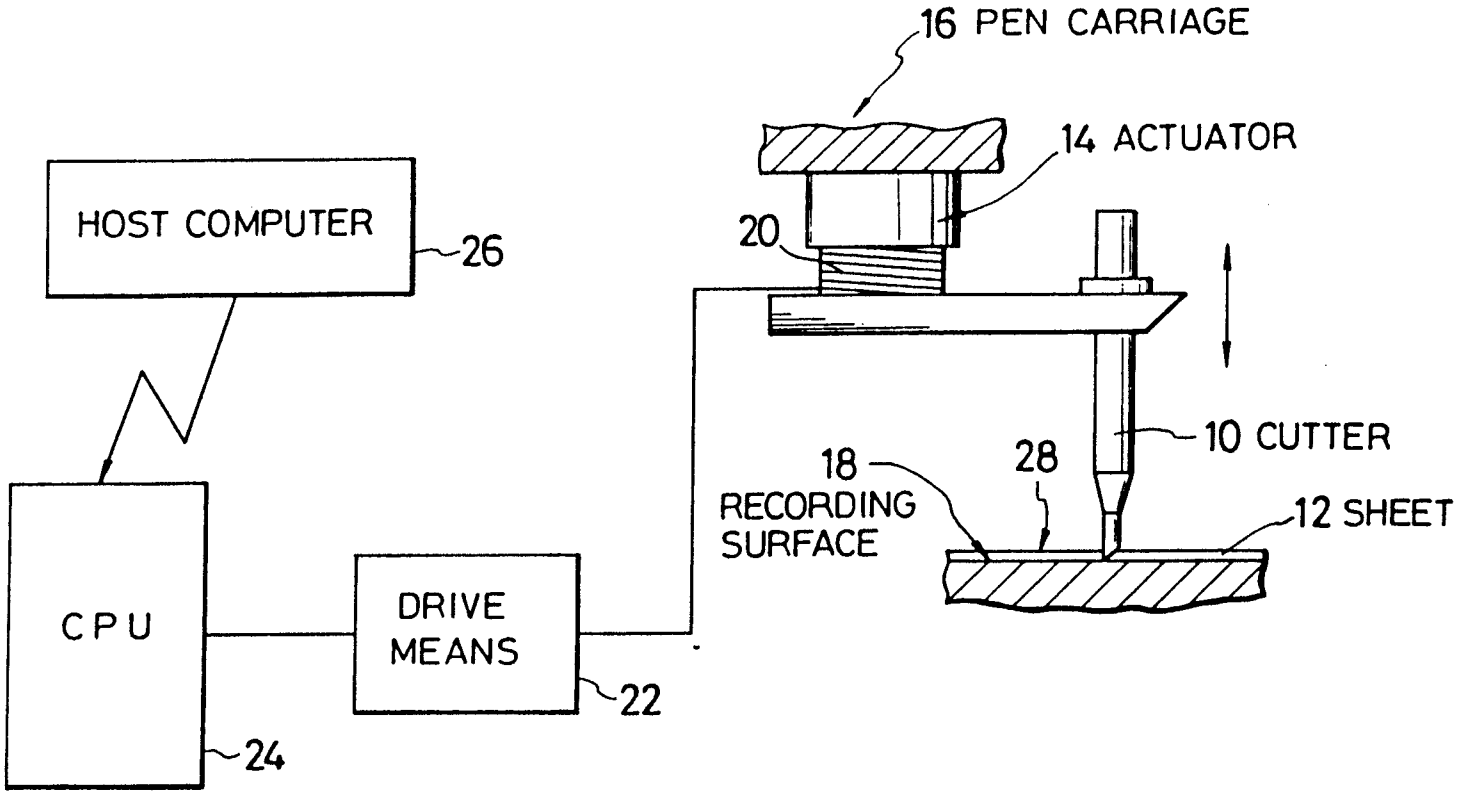
FIG. 1 is a block diagram schematically showing an example of a cutting plotter suitable for use for practicing a method of forming a perforated cut line according to the present invention.

A cutting plotter shown in FIG. 1 includes a cutter 10 through which the cutting plotter forms a sheet 12 with a perforated cut line along which the sheet is to be cut out, an actuator 14 for directly grasping or holding the cutter 10, and a pen carriage 16 on which the actuator 14 is provided or mounted. The sheet 12 is supported or put on a recording surface 18. The actuator 14 is driven by a coil 20. More particularly, when the supplying and interrupting of an electrical current with respect to the coil 20 are carried out or the direction of flowing of the current is varied, the cutter 10 supported on the recording surface 18 is vertically moved with respect to the sheet 12. Also, a variation in magnitude of a current flowing through the coil 20 causes a cutter pressure, which is the pressure of the cutter 10 when pressed onto the sheet 12 placed on the recording surface 18 with respect to the sheet 12, to be varied. Further, when force of a level exceeding a predetermined pressure is upwardly applied to the cutter 10 while the cutter 10 is pressed onto the sheet 12 at the predetermined cutter pressure, the cutter 10 kept pressed against the sheet 12 is caused to be raised above the sheet or to an intermediate position within the sheet 12. Such-force may be produced by a repulsion force of the sheet such as its resiliency or the like. Thus, the cutting plotter permits the cutter 10 supported on the actuator 14 to be vertically moved with respect to the sheet 12 positioned on the recording surface 18 while the cutter pressure is varied.

Further, the cutting plotter may be so constructed that the direction of cutting the sheet is varied as desired. For the purpose of varying the direction of advance of the cutter depending upon a variation in the direction of the sheet 12, a rotation means may be provided which is adapted to rotate the cutter and hold it in any desired direction.

The cutting plotter also includes a drive means 22 connected to the coil 20 of the actuator 14 for driving the actuator 14 on which the cutter 10 is supported. The drive means 22 makes a current flow through the coil 20 of the actuator 14, interrupts the flowing of the same and controls the magnitude and direction of the current flowing through the coil 20. The drive means 22 is also connected to a central processing unit (CPU) 24 which is then connected to a host computer 26 and adapted to be actuated depending upon a command from the host computer 26, so that the drive means 22 may be controlled by the CPU 24. Also, the CPU 24 is adapted to control an X-direction transfer means (not shown) for transferring the pen carriage 16 in an X-direction and a Y-direction transfer means (not shown) for forcibly transferring the sheet 12 in a Y-direction while keeping the sheet interposed between a grit roller (not shown) and a pinch roller (not shown) vertically arranged. Both the X-direction transfer means and Y-direction transfer means may be comprised of a servo motor or the like.

Now, a method of forming a perforated cut line according to the present invention will be described in connection with an embodiment in which perforations are formed on a cut line which is predetermined or described with respect to a sheet and along which the sheet is to be subsequently cut out using the cutting plotter described above, so that the sheet can be used as an apparel paper pattern, a bag or the like.

First, a sheet 12 is placed on the recording surface 18 formed into a suitable shape such as a semi-circular shape or the like. Then, the drive means 22 is actuated through the CPU 24 to drive the actuator 14, to thereby lower the cutter 10 supported on the actuator 14 onto the sheet 16 put on the recording surface 18. Subsequently, a current of a predetermined magnitude is made to flow in a predetermined direction through the coil 20 of the actuator 14, resulting in the cutter 10 being contactedly pressed onto the sheet 12 at a predetermined cutter pressure in a vertically movable manner.

Then, the X-direction transfer means and Y-direction transfer means are actuated through the CPU 24, to thereby move the sheet 12 in the Y-direction on the recording surface 18 and concurrently move the pen carriage 16 in the X-direction, resulting in the pen carriage 16 being relatively transferred in the X and Y directions with respect to the sheet 12. This causes the cutter 10 supported on the actuator 14 of the pen carriage 16 to be moved in the X and Y directions relative to the sheet 12.

Figure 2:
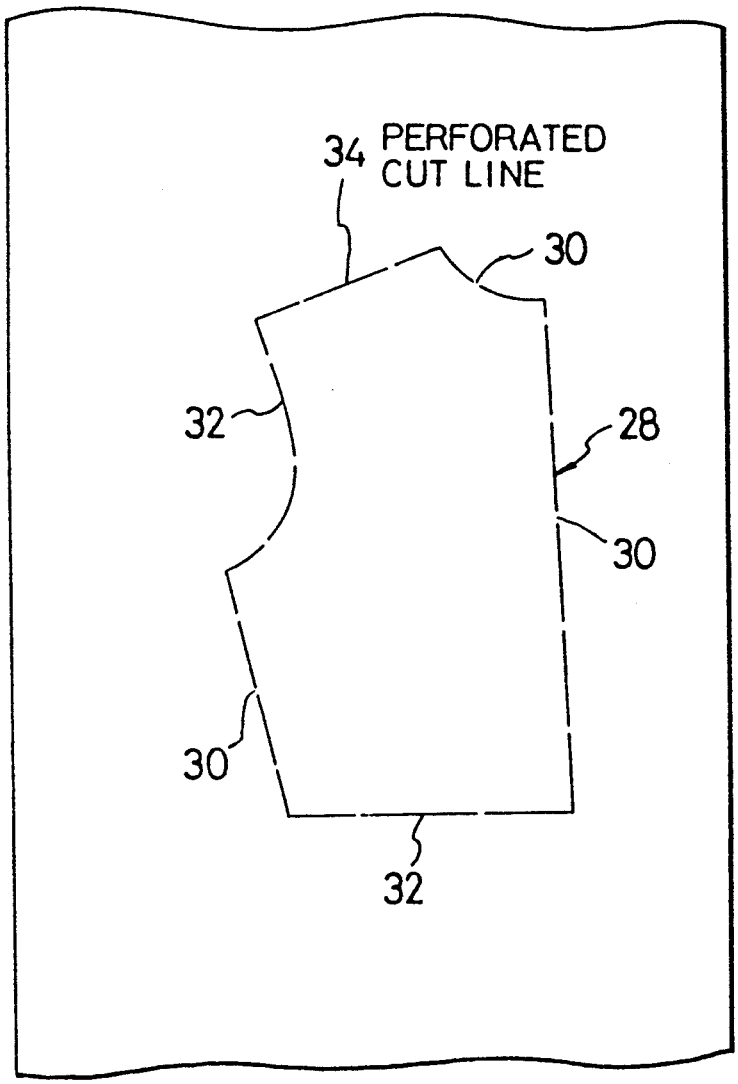
FIG. 2 is a plan view showing a sheet on which perforations are formed for forming the sheet into an apparel paper pattern utilizing a method of forming a perforated cut line according to the present invention.
Figure 3:
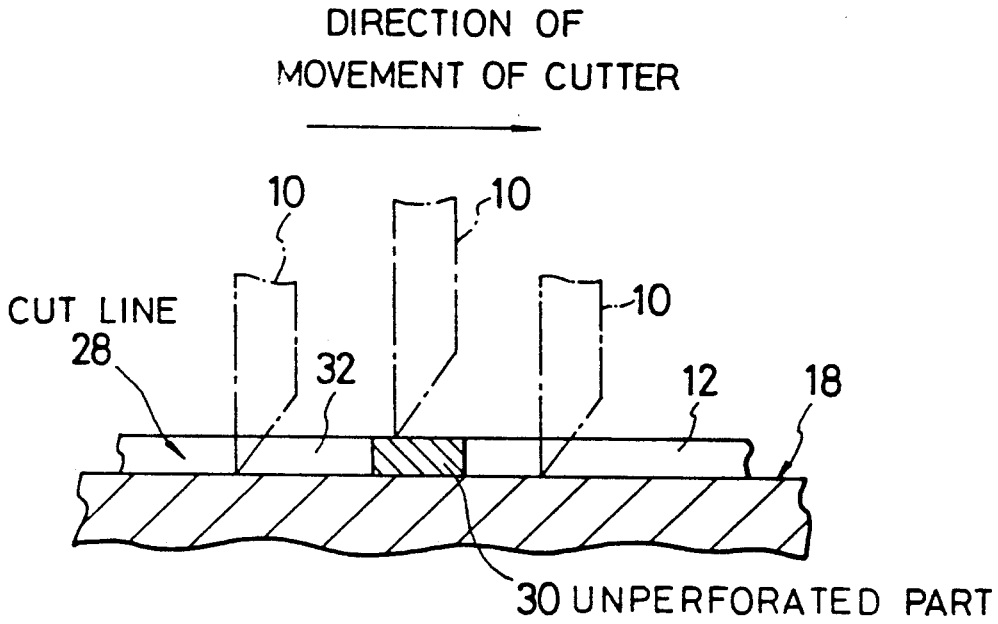
FIG. 3 is a schematic view showing a manner of forming unperforated parts on a cut line by a method of forming a perforated cut line according to the present invention.
Figure 4:
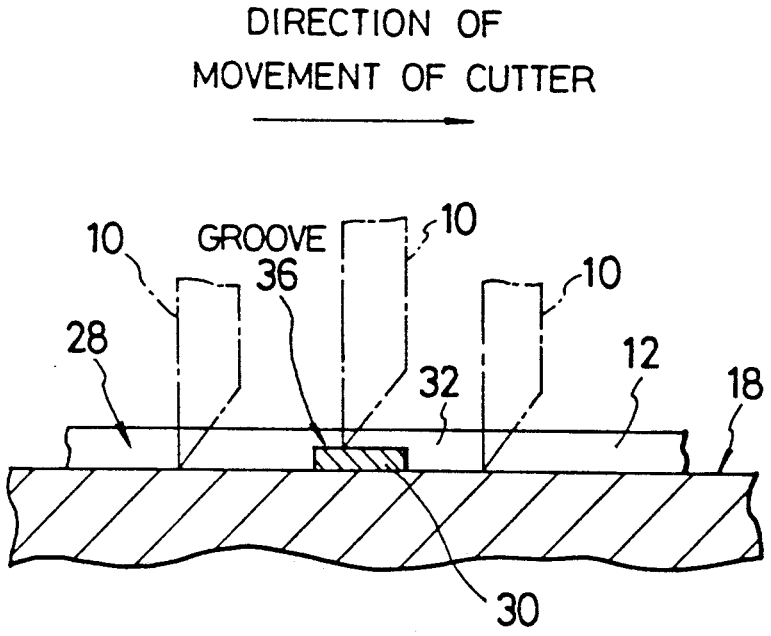
FIG. 4 is a schematic view showing another manner of forming unperforated parts on a cut line by a method of forming a perforated cut line according to the present invention.

Thus, the cutter 10 is relatively moved in the X and Y directions on the sheet 12 with respect to the sheet while being contactedly pressed onto the sheet at the predetermined cutter pressure as described above, to thereby cut the sheet 12, during which process the CPU 24 operated depending upon a command generated from the host computer 26 repeatedly reduces the predetermined cutter pressure for a micro period of time at fixed time intervals. This causes the pressure of the cutter which is carrying out the sheet cutting operation along a cut line 28 predetermined or described in advance with respect to the sheet 12 as shown in FIG. 3 or 4 to be repeatedly reduced, so that the cutter 10 is repeatedly raised to substantially the same level as the upper surface of the sheet 12 as shown in FIG. 3 or to an intermediate position within the sheet 12 as shown in FIG. 4 for a micro period of time at predetermined time intervals due to the repulsion force of the sheet 12 or its elastic force. This results in the sheet 12 being intermittently formed with unperforated parts 30 of a small length at predetermined intervals along the cut line 28 and the remaining part of the cut line 28 other than the unperforated parts 30 being formed with perforations 32 in a manner to be interposed between the unperforated parts 30, by the cutting described above. Thus, the sheet is formed with a perforated cut line 34 along the cut line 28 as shown in FIG. 2. The cut line 28 may be described directly on the sheet 12.

When the unperforated parts 30 are to be formed at predetermined intervals on the sheet 12 along the cut line 28, the cutter pressure may be reduced to such a degree that a groove 36 of a given depth is caused to be formed on each of the unperforated parts 30 of the sheet 12 put on the recording surface 18. The so-formed grooves 36 permit the unperforated parts 30 to be accurately laterally torn with ease.

Also, when the unperforated parts 30 are to be formed at predetermined intervals on the sheet 12 along the cut line 28, the actuator 14 may be driven so as to repeatedly reduce the cutter pressure for a micro period of time at predetermined time intervals while the cutter is relatively and continuously moved in the X and Y directions with respect to the sheet 12 by means of the X-direction transfer means and Y-direction transfer means. This permits the movement of the cutter 10 relative to the sheet 12 to be continuously carried out without any interruption, so that the perforated cut line 34 may be formed at an increased speed.

Further, in the formation of the unperforated parts 30 on the cut line 28 of the sheet 12, the movement of the cutter 10 relative to the sheet 12 may be stopped each time the formation of one of the unperforated parts 30 is started and terminated. This permits the unperforated parts 30 to be accurately formed.

It is a matter of course that the present invention may be likewise effectively practiced using a flat-bed type cutting plotter which includes a pen carriage arranged so as to be movable in X and Y directions with respect to a sheet put on a recording surface formed into a flat or planar shape or the like and provided with a cutter. In this instance, the cutter may be actuated to form perforations on the sheet along a cut line while being kept pressed onto the sheet on the recording surface, without repeatedly driving the cutter to move vertically at predetermined time intervals as in the paper moving type cutting plotter described above. This permits the perforations to be formed at an increased speed.

As can be seen from the foregoing, the method of the present invention permits the perforation forming operation to be carried out while keeping the cutter lowered onto the sheet put on the recording surface and eliminating repeating of both the raising of the cutter above the sheet and the lowering of the cutter onto the sheet as required in the prior art, resulting in the perforated cut line being rapidly and accurately formed. Also, the method of the present invention may be so constructed that the cutter pressure is reduced to such a degree that a groove of a given depth is caused to be formed on each of the unperforated parts of the sheet. Such construction permits each of the unperforated parts to be accurately laterally torn through the so-formed grooves with ease. Further, in the method of the present invention, the cutter pressure is repeatedly reduced for a micro period of time at predetermined time intervals while the cutter is continuously moved relative to the sheet, so that the perforated cut line may be formed at an increased speed.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A method of forming a perforated cut line by a cutting plotter adapted to relatively move a pen cartridge in X and Y directions with respect to a sheet while contactedly pressing a cutter supported on the pen carriage onto the sheet at a predetermined cutter pressure in a manner to be vertically movable with respect to the sheet, comprising the steps of:

repeatedly reducing said cutter pressure for a micro period of time at predetermined time intervals to form the sheet with a perforated cut line comprising perforations and unperforated parts defined between said perforations, wherein the reduction of said cutter pressure is carried out to such a degree that a groove of a given depth is caused to be formed on each of said unperforated parts.

2. A method as defined in claim 1, wherein the cutting plotter is of the flat-bed type.

3. A method as defined in claim 1, wherein said repeated reduction of the cutter pressure is carried out while the cutter is relatively and continuously moved in the X and Y directions with respect to the sheet.

4. A method as defined in claim 1, wherein the relative movement of the cutter relative to the sheet is stopped every time the formation of one of said unperforated parts is started and terminated.

5. A method as defined in claim 1, wherein the cutting plotter is of the paper moving type.

6. An improved method of cutting a sheet of flexible material by moving a cutter against the sheet at a predetermined cutter pressure, comprising the steps of:

positioning the cutter adjacent the sheet;

causing a predetermined pressure to be exerted against the cutter sufficient to cut the sheet;

relatively moving the cutter and the sheet along a predetermined cut line to form a pattern; and varying the amount of pressure to the cutter to provide a series of perforations along the cut line spaced by unperforated segments, wherein the amount of pressure variation applied to the cutter causes grooves to be formed in the unperforated segments, and the pattern does not prematurely separate from the sheet to cause problems.

7. An improved method of cutting a sheet of flexible material by moving a cutter against the sheet at a predetermined cutter pressure, comprising the steps of:

positioning the cutter adjacent the sheet;

causing a predetermined pressure to be exerted against the cutter sufficient to cut the sheet;

relatively moving the cutter and the sheet along a predetermined cut line to form a pattern; and varying the amount of pressure to the cutter to provide a series of perforations along the cut line spaced by unperforated segments, whereby the pattern does not prematurely separate from the sheet to cause problems, wherein the amount of pressure variation applied to the cutter leaves the cutter in constant contact with the sheet as it moves along the cut line.

8. A method as defined in claim 7, wherein the amount of pressure variation applied to the cutter causes grooves to be formed in the unperforated segments.

* * * * *